United States Patent [19]

Bogusz

[11] 3,958,279

[45] May 25, 1976

[54] RECIRCULATING SEWERAGE SYSTEM

[75] Inventor: Frank J. Bogusz, Farmington, Conn.

[73] Assignee: Koehler-Dayton, Inc., New Britain, Conn.

[22] Filed: Oct. 30, 1974

[21] Appl. No.: 519,085

Related U.S. Application Data

[63] Continuation-in-part of Ser. No. 428,337, Dec. 26, 1973, abandoned.

[52] U.S. Cl. ..... 4/10; 4/79; 210/152

[51] Int. Cl.[2] ..... E03D 5/016

[58] Field of Search ..... 4/1, 8, 10, 11, 76–80, 4/115, 69, 89, 90; 210/152, 167, 498

[56] References Cited

UNITED STATES PATENTS

| | | | |
|---|---|---|---|
| 3,563,384 | 2/1971 | Delaney et al. | 4/10 X |
| 3,674,148 | 7/1972 | Miller | 210/152 |
| 3,701,426 | 10/1972 | Wetzel | 210/152 |
| 3,727,241 | 4/1973 | Drouhard et al. | 4/10 |
| 3,815,159 | 6/1974 | Delaney et al. | 4/10 |
| 3,839,745 | 10/1974 | Bramall | 4/11 |

*Primary Examiner*—Richard E. Aegerter
*Assistant Examiner*—Stuart S. Levy
*Attorney, Agent, or Firm*—Spencer T. Smith

[57] ABSTRACT

A recirculating sewage system comprising a toilet, a recirculating tank, means for draining the recirculating tank, means for directing the effluent flushed from the toilet into the recirculating tank, pump means communicating with the recirculating tank, means for operating the system in a flushing mode including means for energizing the pump means and means for recirculating the effluent discharged by the pump means to the toilet to flush same, and means for operating the system in a drain mode including means for energizing the pump means and means for recirculating the effluent discharged by the pump means to the recirculating tank to establish turbulence in the contents thereof whereby when the draining means is activated, operation of the system in the drain mode will assure a more effective drainage of the recirculating tank.

12 Claims, 5 Drawing Figures

Fig_1 (PRIOR ART)
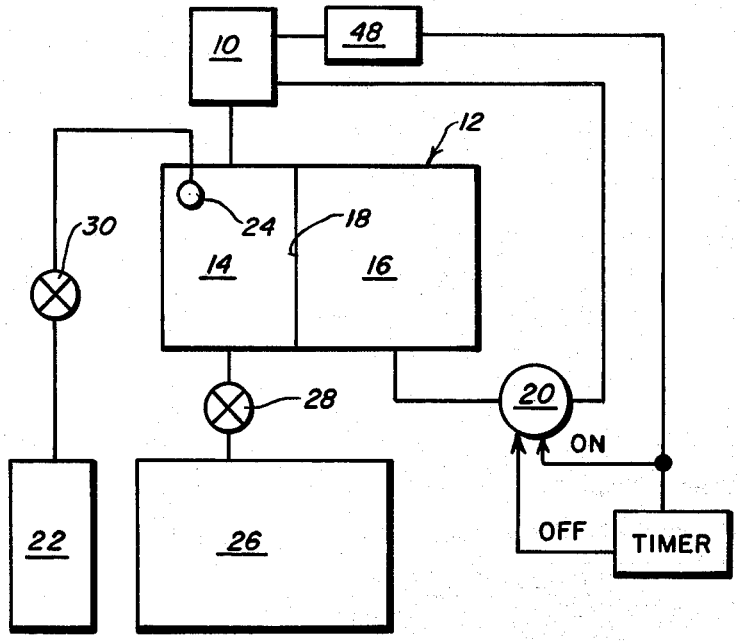
Fig_2 (PRIOR ART)
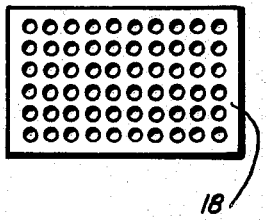
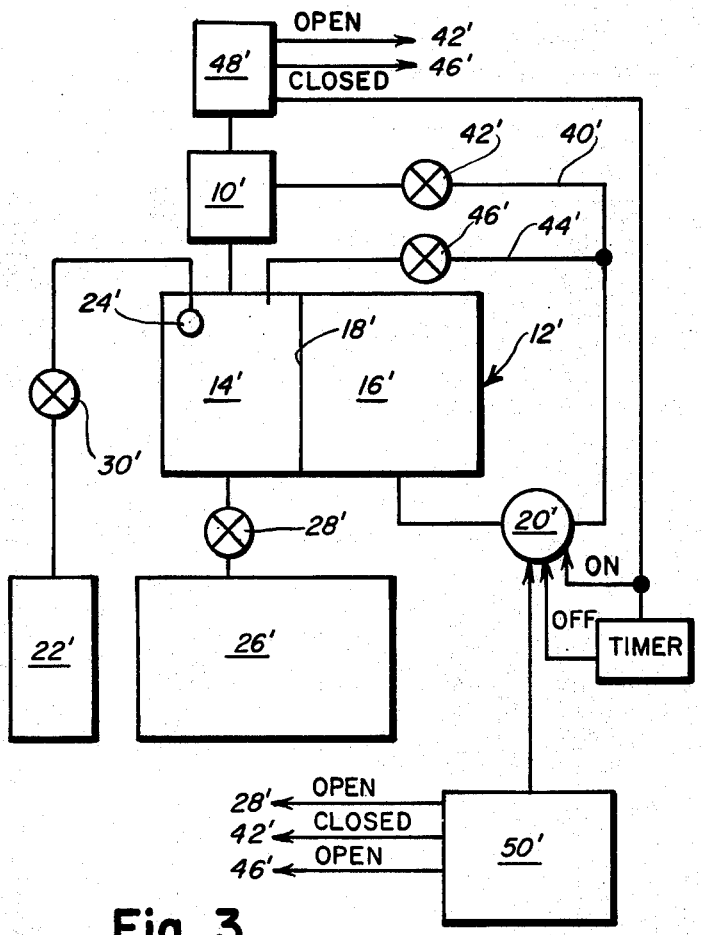
Fig_3
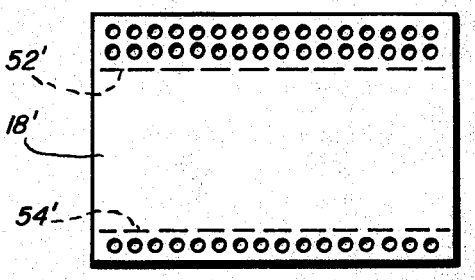
Fig_4

RECIRCULATING SEWERAGE SYSTEM

This application is a continuation-in-part of copending application Ser. No. 428,337, filed on Dec. 26, 1973, now abandoned.

The present invention relates to recirculating sewage systems wherein the effluent flushed from a toilet is discharged into a recirculating tank and a part of the effluent is periodically recirculated to flush the toilet.

Conventional recirculating sewage systems are completely drained either when the recirculating tank fills up to a predetermined level or after the passage of a predetermined interval of time by opening a drain valve. Since in either event the system will have been in operation for a considerable period of time, the recirculating tank will contain a substantial volume of solids including paper products and the like which tend to clump together during the draining operation inhibiting complete drainage. To assure that the recirculating tank is completely drained, at least one rinsing charge is visually introduced into the recirculating tank and subsequently drained.

It is, accordingly, an object of the present invention to provide a recirculating sewage system wherein the solids contained in the recirculating tank can be more effectively drained from the recirculating tank.

Among the advantages of the present invention is the provision of a recirculating sewage system which minimizes the amount of rinsing liquid, usually potable water, required to completely drain the system.

Other objects and advantages of the present invention will become apparent from the following portion of this specification and from the accompanying drawings which illustrate, in accordance with the mandate of the patent statutes, presently preferred embodiments incorporating the teachings of the invention.

Referring to the drawing:

FIG. 1 is a diagrammatic representation of a prior art recirculating system;

FIG. 2 is a diagrammatic representation of the filter utilized in the system illustrated in FIG. 1;

FIG. 3 is a diagrammatic representation of a recirculating sewage system having a first preferred embodiment made in accordance with the teachings of the present invention;

FIG. 4 is a diagrammatic representation of the filter made in accordance with the teachings of the present invention.

Figure 5:
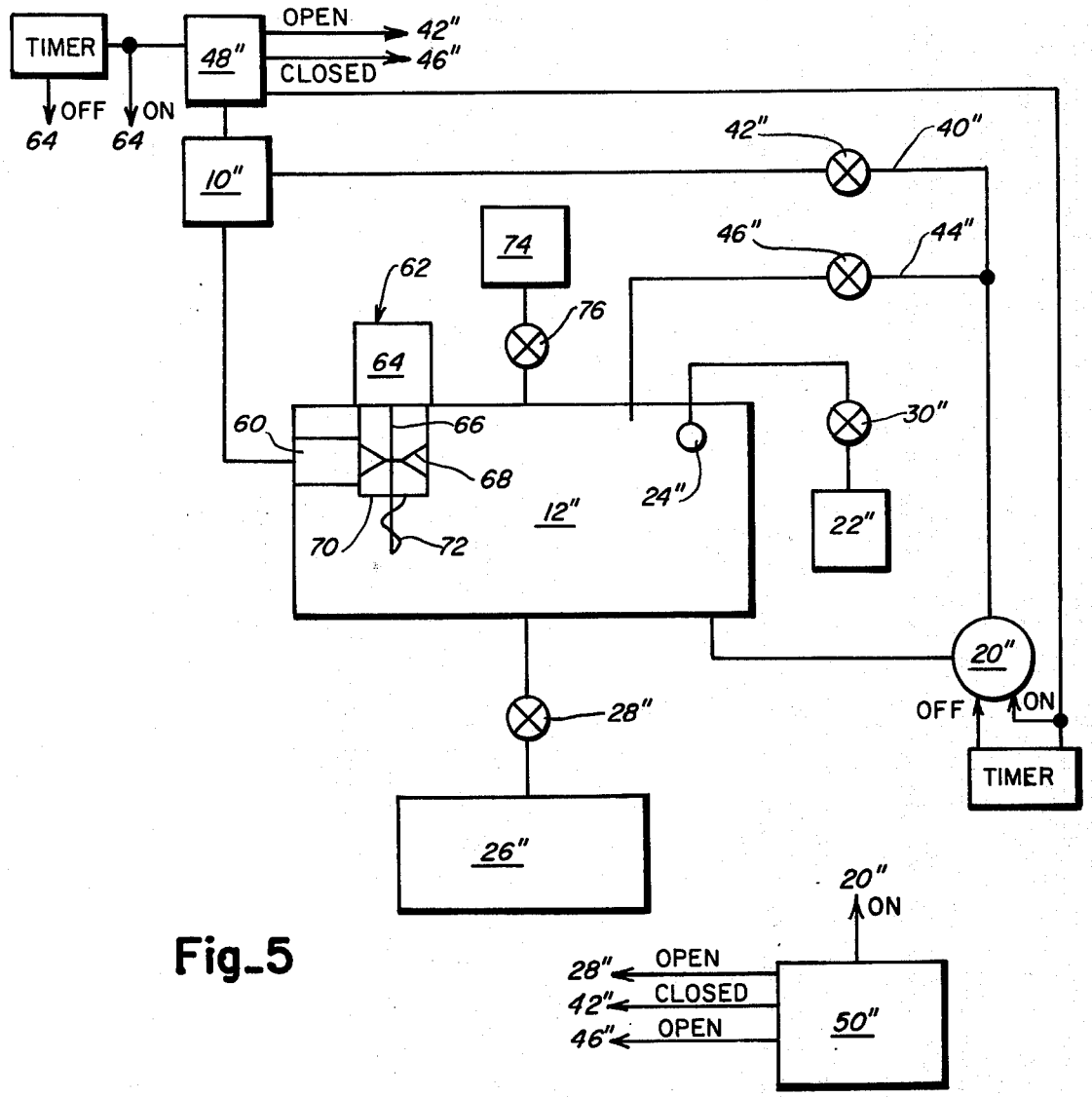
FIG. 5 is a diagrammatic representation of a recirculating sewage system having a second preferred embodiment, made in accordance with the teachings of the present invention.

Prior art recirculating sewage systems (FIG. 1) conventionally include one or more toilets 10, a recirculating tank 12 having horizontally adjacent receptacle 14 and filtrate 16 compartments separated by vertically extending filtering media 18 (FIG. 2), a flush pump 20, a pressurized source of priming liquid 22, a rinsing nozzle 24 and a holding tank 26.

To properly prime the system prior to use, the drain valve 28 is closed and the prime control valve 30 is briefly opened allowing a predetermined charge of priming liquid to be introduced from the pressurized source of priming liquid 22, through the rinsing nozzle 24 into the receptacle compartment 14 of the recirculating tank. The charge of prime is supplied to the receptacle compartment at a medium head-low volume. After the priming charge has been introduced into the recirculating tank, the prime control valve 30 is closed.

Once the system is properly primed, closing the start switch 48 energizes the flush pump 20 for a predetermined interval of time whereby liquid from the filtrate compartment 16 will be pumped under pressure into the toilet to flush the toilet. The flush pump conventionally is a low head-high volume pump to assure that a high volume of flushing liquid will pass around the bowl of the toilet to properly abrasively clean the toilet bowl surface. The flushed effluent is discharged into the receptacle compartment 14 and a portion of the liquid effluent filters through the filter element 18 into the filtrate compartment.

After the passage of a predetermined period of time or when the liquid level within the recirculating tank reaches a predetermined level, the recirculating tank must be serviced. The drain valve 28 is opened and the entire contents of the recirculating tank is discharged into the holding tank 26.

Once the recirculating tank has been drained and the drain valve 28 has again been closed, prime control valve 30 is briefly opened to introduce a predetermined rinsing charge through the rinsing nozzle 24 into the receptacle compartment whereby any solids which have clogged the drain line will be floated free and the walls of the receptacle compartment will be to at least some degree rinsed and thereby cleaned. After the rinsing charge has been introduced into the recirculating tank, the prime control valve 30 is closed and the drain valve is opened until the recirculating tank is fully drained. With the drain valve again closed and the prime control valve briefly opened, a predetermined flushing charge is introduced into the recirculating tank whereupon the prime control valve is closed. The system is again operational.

In accordance with the present invention (FIGS. 3 and 4), the efficiency of the drain cycle is greatly increased by establishing turbulence in the contents of the receptacle compartment as the recirculating tank is being drained by operating the flush pump during the draining of the tank and discharging the flush pump into the receptacle compartment.

In the disclosed system, a pair of parallel flow paths are provided for the output of the flush pump. A first path 40' communicates with the toilet and is controlled by a flush valve 42' and a second path 44' communicates with the receptacle compartment 14' and is controlled by a rinse valve 46'.

In the normal flush mode of operation, closing the start switch 48' opens the flush valve 42', closes the rinse valve 46' and energizes the flush pump 20'. The flush pump accordingly directs a high volume of filtrate at a medium to high head to the toilet for a predetermined interval of time to flush the toilet.

In the drain mode of operation, closing drain switch 50 closes the flush valve 42', opens the rinse valve 46', energizes the flush pump and opens the drain valve 28'. The high volume discharge of the flush pump is accordingly discharged at a high velocity into the receptacle compartment thereby establishing turbulence within the contents of the receptacle compartment as it is drained. The location, orientation and area of the conduit through which the filtrate is discharged into the receptacle compartment can be selectively chosen to maximize the effect of the turbulence.

Whereas in the prior art (FIG. 2) the baffle 18 which divides the recirculating tank into receptacle 14 and filtrate compartments includes numerous equally spaced and sized openings extending over the entire area of the baffle, the baffle 18' of the present invention (FIG. 4) includes such openings only above the maximum design liquid level 52' of the effluent contained within the receptacle compartment and along the bottommost portion of the baffle 18' below the flushing prime liquid level 54'. The flow rate from the receptacle compartment to the filtrate compartment, resulting from an increase in the liquid level within the receptacle compartment relative to the liquid level within the filtrate compartment, is minimized. The liquid level within the receptacle compartment will accordingly be maintained by the high volume discharge of the flush pump during the drain mode of operation whereby the turbulence established within the receptacle compartment will have maximum effect. The receptacle compartment can thereby be completely drained without the use of any externally supplied liquid (usually potable water).

In order to maximize the efficiency of the system, the volume of the waste in the receptacle compartment should be minimized while maximizing the volume of the waste in the filtrate compartment, and, accordingly, the configuration of the receptacle compartment should be chosen so that when the recirculating tank has been filled to a predetermined level or after the passage of a predetermined interval of time and the recirculating tank is to be drained, the density of the effluent in the receptacle compartment should be at the highest level which would be possible without deleteriously effecting the operation of the system.

In the second preferred embodiment illustrated in FIG. 5, the recirculating tank 12'' has a single compartment which contains all of the effluent flushed from the toilet 10''. The flushed effluent enters into the inlet port 60 of the recirculating tank and passes through a macerating and mixing device 62 which reduces the particle size of the contained solids and vigorously agitates the macerated sewage. The unit 62 includes a motor 64 which rotates a shaft 66 to which are affixed a plurality of radially extending blades 68, a substantially discshaped member 70 and a helical flight 72. The adjacent blades 68 have their distal portions directed alternately upwardly and downwardly and the clearance between the ends of the blades and the substantially cylindrical wall 74 as well as the distance between the periphery of the disk 76 and the wall 78 is maintained relatively small to prevent large particles of sewage from entering the recirculating tank.

The helical flight 72, in addition to agitating the contents of the chamber 80, also functions to remacerate the sewage.

The macerating and mixing device is selectively operational only during the flushing mode of operation and its associated timer has a period predetermined to assure that all flushed effluent will be properly and completely macerated and discharged into the recirculating tank.

If desired, a source of sewage treating additive 74 can be provided and selected amounts can be introduced into the system by momentarily opening a control valve 76.

What is claimed is:

1. A recirculating sewage system comprising
a toilet, a recirculating tank,
a drain conduit communicating with the bottom portion of said recirculating tank,
valve means for controlling the gravitational flow of sewage from said recirculating tank through said drain conduit,
means for directing the effluent flushed from said toilet into said recirculating tank,
normally deenergized pump means communicating with said recirculating tank
means for operating the system in a flushing mode whenever said toilet is to be flushed including means for energizing said pump means and means for recirculating the effluent discharged by said pump means to said toilet to flush same, and
means for operating the system in a drain mode whenever the recirculating tank is to be drained including means for energizing said pump means, means for opening said valve means whereby the sewage will gravitationally flow out of said recirculating tank through said drain conduit, and means for recirculating the effluent discharged by said pump means to said recirculating tank to establish turbulence in the contents thereof whereby a more effective drainage of said recirculating tank will be assured.

2. A recirculating sewage system according to claim 1, wherein said pump means comprises a single pump.

3. A recirculating sewage system according to claim 1, wherein said directing means comprises macerating and mixing means.

4. A recirculating sewage system according to claim 3, further comprising a source of sewage treating additives and means for selectively introducing the additives into said recirculating tank.

5. A recirculating sewage system comprising
a toilet,
a recirculating tank including a receptacle compartment,
a drain conduit communicating with the bottom portion of said receptacle compartment,
valve means for controlling the gravitational flow of sewage from said receptacle compartment through said drain conduit,
means for directing the effluent flushed from said toilet into said receptacle compartment,
normally deenergized pump means communicating with said recirculating tank,
filter means intermediate said receptacle compartment and said pump means,
means for operating the system in a flushing mode whenever said toilet is to be flushed including means for energizing said pump means, and means for recirculating the liquid discharged by said pump means to said toilet to flush same,
means for operating the system in a drain mode whenever the recirculating tank is to be drained including
means for energizing said pump means,
means for opening said valve means whereby the sewage will gravitationally flow out of said recirculating tank through said drain conduit, and
means for recirculating the liquid discharged by said pump means to said receptacle compartment to establish turbulence in the contents thereof whereby a more effective drainage of said receptacle compartment will be assured.

6. A recirculating sewerage system according to claim 5, further comprising a baffle dividing said recirculating tank into horizontally adjacent receptacle and filtrate compartments, said filter means comprising said baffle.

7. A recirculating sewerage system according to claim 6, wherein said baffle includes opening means disposed only along the lower most portion thereof below the flushing prime liquid level and above the maximum design liquid level of the effluent contained within said receptacle compartment.

8. A recirculating sewerage system according to claim 6, wherein said pump means comprises a single pump.

9. A recirculating sewerage system comprising a toilet, a receptacle compartment, means for directing at least the solid portion of the effluent flushed from said toilet into said receptacle compartment, a filtrate compartment, means including filtering media for selectively directing at least a portion of the liquid component of the effluent flushed from said toilet into said filtrate compartment, a drain conduit communicating with the bottom portion of said receptacle compartment, valve means for controlling the gravitational flow of sewage from said receptacle compartment through said drain conduit, normally deenergized pump means communicating with said filtrate compartment, means for operating the system in a flushing mode whenever said toilet is to be flushed including means for energizing said pump means, and means for recirculating the liquid discharged by said pump means to said toilet to flush same, and means for operating the system in a drain mode whenever the receptacle compartment is to be drained including means for energizing said pump means, means for opening said valve means whereby the sewage will gravitationally flow out of said receptacle compartment through said drain conduit, and means for recirculating the liquid discharged by said pump means to said receptacle compartment to establish turbulence in the contents thereof whereby a more effective drainage of said receptacle compartment will be assured.

10. A recirculating sewerage system according to claim 9, wherein said receptacle and filtrate compartments are horizontally adjacent and are separated by a baffle including said filtering media.

11. A recirculating sewerage system according to claim 10, wherein said baffle includes opening means disposed only along the lowermost portion thereof below the flushing prime liquid level and above the maximum design liquid level of the effluent contained within said receptacle compartment.

12. A recirculating sewerage system according to claim 9, wherein said pump means comprises a single pump.

* * * * *